US009607744B2

(12) United States Patent
Hirano et al.

(10) Patent No.: US 9,607,744 B2
(45) Date of Patent: Mar. 28, 2017

(54) LASER PROCESSING APPARATUS AND LASER IRRADIATION METHOD

(71) Applicant: NIPPON STEEL & SUMITOMO METAL CORPORATION, Tokyo (JP)

(72) Inventors: Koji Hirano, Kisarazu (JP); Hirofumi Imai, Kisarazu (JP); Hideyuki Hamamura, Futtu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 35 days.

(21) Appl. No.: 14/439,996

(22) PCT Filed: Nov. 7, 2013

(86) PCT No.: PCT/JP2013/080092
§ 371 (c)(1),
(2) Date: Apr. 30, 2015

(87) PCT Pub. No.: WO2014/073599
PCT Pub. Date: May 15, 2014

(65) Prior Publication Data

US 2015/0318091 A1 Nov. 5, 2015

(30) Foreign Application Priority Data

Nov. 8, 2012 (JP) ..... 2012-246305

(51) Int. Cl.
*C21D 8/02* (2006.01)
*C21D 8/10* (2006.01)
(Continued)

(52) U.S. Cl.
CPC ..... *H01F 1/14775* (2013.01); *C21D 1/34* (2013.01); *C21D 6/008* (2013.01); *C21D 8/1294* (2013.01);
(Continued)

(58) Field of Classification Search
CPC ..... C21D 8/02; C21D 8/10; C21D 8/12
(Continued)

(56) References Cited

U.S. PATENT DOCUMENTS 4,456,812 A * 6/1984 Neiheisel ..... B23K 26/0846 148/111
4,468,551 A 8/1984 Neiheisel
(Continued)

FOREIGN PATENT DOCUMENTS

CN 101415847 A 4/2009
EP 0260927 A2 3/1988
(Continued)

OTHER PUBLICATIONS

Chinese Office Action and Search Report for Chinese Application No. 201380057184.9, dated Jan. 19, 2016, with an English translation of the Search Report only.
(Continued)

*Primary Examiner* — Samuel M Heinrich
(74) *Attorney, Agent, or Firm* — Birch, Stewart, Kolasch & Birch, LLP

(57) ABSTRACT

A laser processing apparatus includes a laser irradiation unit has a structure providing an intensity distribution of the laser beam focused on the grain-oriented electrical steel sheet on a cross-section in a direction perpendicular to the scanning direction on the grain-oriented electrical steel sheet so as to satisfy $Ib/Ia \leq 2$, where $Ra_1$ and $Ra_2$ are distances between the centroid of the intensity distribution and positions at which the intensity integration value from the centroid of the intensity distribution is 43% of the total intensity integration value, beam intensities $Ia_1$ and $Ia_2$ are intensities of the laser beam corresponding to $Ra_1$ and $Ra_2$, respectively, Ia is the average value of $Ia_1$ and $Ia_2$ and Ib is the beam intensity at the centroid of the intensity distribution.

20 Claims, 9 Drawing Sheets

(51) Int. Cl.

| | |
|---|---|
| ***C21D 8/12*** | (2006.01) |
| ***H01F 1/147*** | (2006.01) |
| ***C21D 1/34*** | (2006.01) |
| ***C21D 6/00*** | (2006.01) |
| ***C21D 9/46*** | (2006.01) |
| ***H01F 1/16*** | (2006.01) |
| ***H01F 41/02*** | (2006.01) |
| ***C22C 38/06*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C21D 9/46* (2013.01); *C22C 38/001* (2013.01); *C22C 38/02* (2013.01); *C22C 38/04* (2013.01); *C22C 38/06* (2013.01); *H01F 1/16* (2013.01); *H01F 41/02* (2013.01); *C21D 8/02* (2013.01); *C21D 8/10* (2013.01); *C21D 8/12* (2013.01)

(58) Field of Classification Search
USPC ..... 148/110–113, 307, 308; 219/121.6, 219/121.61, 121.73, 121.85
See application file for complete search history.

(56) References Cited

U.S. PATENT DOCUMENTS

| | | | | |
|---|---|---|---|---|
| 4,554,029 | A * | 11/1985 | Schoen | C21D 8/1294 148/111 |
| 4,645,547 | A * | 2/1987 | Krause | C21D 1/09 148/111 |
| 4,909,864 | A | 3/1990 | Inokuti et al. | |
| 6,368,424 | B1 | 4/2002 | Sakai et al. | |
| 9,346,123 | B2 * | 5/2016 | Okabe | B23K 26/0846 |
| 2006/0169362 | A1 | 8/2006 | Sakai et al. | |
| 2009/0114316 | A1 | 5/2009 | Sakai et al. | |

FOREIGN PATENT DOCUMENTS

| | | | |
|---|---|---|---|
| EP | 0 870 843 | A1 | 10/1998 |
| EP | 0897016 | A1 | 2/1999 |
| JP | 59-33802 | A | 2/1984 |
| JP | 63-83227 | A | 4/1988 |
| JP | 64-230 | A | 1/1989 |
| JP | 1-51527 | B2 | 11/1989 |
| JP | 10-204533 | A | 8/1998 |
| JP | 2007-119821 | A | 5/2007 |
| JP | 2010-105037 | A | 5/2010 |
| JP | 2012-140665 | A | 7/2012 |
| RU | 2044066 | C1 | 9/1995 |
| RU | 2243072 | C2 | 12/2004 |
| RU | 2276191 | C1 | 5/2006 |
| WO | WO 97/24466 | A1 | 7/1997 |
| WO | WO 98/32884 | A1 | 7/1998 |
| WO | WO 2004/083465 | A1 | 9/2004 |
| WO | WO 2011/016758 | A1 | 2/2011 |
| WO | WO 2011/125672 | A1 | 10/2011 |

OTHER PUBLICATIONS

Japanese Office Action dated Sep. 15, 2015, issued in Japanese Patent Application No. 2014-545746.
Construction Method Committee, Light Metal Welding, 2007, vol. 45, No. 12.
International Search Report issued in PCT/JP2013/080092, mailed on Feb. 10, 2014.
Notification issued in Japanese Patent Application No. 2014-545746, mailed on Mar. 17, 2015.
PCT/ISA/237—Issued in PCT/JP2013/080092, mailed on Feb. 10, 2014.
Extended European Search Report, dated Jun. 14, 2016, for European Application No. 13852814.6.
Russian Office Action and Search Report for Russian Application No. 2015116262, dated Oct. 27, 2016, with an English translation.

* cited by examiner

LASER PROCESSING APPARATUS AND LASER IRRADIATION METHOD

FIELD OF THE INVENTION

The present invention relates to a laser processing apparatus and a laser irradiation method in which magnetic domains are controlled by applying a laser beam to a grain-oriented electrical steel sheet used for transformer cores and the like.

Priority is claimed on Japanese Patent Application No. 2012-246305, filed Nov. 8, 2012, the content of which is incorporated herein by reference.

DESCRIPTION OF RELATED ART

A grain-oriented electrical steel sheet has a characteristic of easily allowing the penetration of the magnetic lines of force with respect to the rolling direction during the manufacture of a steel sheet (having an easy magnetization direction along the rolling direction) (henceforth, also referred to as a one-oriented electrical steel sheet), and is used as a material constituting an iron core of electric devices such as a transformer and a rotator. In the grain-oriented electrical steel sheet used for iron cores, there has been a demand to reduce the energy loss (core loss) during magnetization. In particular, recently, in response to the intensifying global warming, there has been a global demand for energy saving in electric devices. As a result, there has been a desire to stably produce grain-oriented electrical steel sheets in which the core loss is reduced as much as possible.

The core loss is classified into an eddy-current loss and a hysteresis loss. Furthermore, the eddy-current loss can be classified into a classical eddy-current loss and an anomalous eddy-current loss. To reduce the classical eddy-current loss, there has been provided a thin grain-oriented electrical steel sheet having an insulation film on the sheet surface. As the grain-oriented electrical steel sheet having an insulation film formed thereon, for example, as described in Patent Document 1, a steel sheet having a double-layered structure in which the surface of a base steel sheet (metal section) is coated with a glass film and the glass film is coated with an insulation film has been proposed and put into practical use.

In addition, to suppress the anomalous eddy-current loss, for example, as described in Patent Documents 2 and 3, there has been proposed a laser magnetic domain control method in which a laser beam is focused and emitted above an insulation film, and the electrical steel sheet is scanned substantially in a width direction of the electrical steel sheet with the laser beam (that is, in a direction substantially perpendicular to the rolling direction) so that a region periodically having residual strain in the rolling direction is provided, thereby reducing a magnetic domain size. According to the laser magnetic domain control method, the scanning and irradiation of a laser beam imparts a temperature history having a strong temperature gradient with respect to the sheet thickness direction to the outermost layer region of the steel sheet, the temperature history generates surface strain, the surface strain causes closure domains, the closure domains reduce the 180° domain wall spacing, and particularly, the anomalous eddy-current loss is reduced.

The closure domains imparted through the laser magnetic domain control reduce the 180° domain wall spacing, and decrease the anomalous eddy-current loss, but also cause an increase in the hysteresis loss. Therefore, from the viewpoint of reducing the total core loss, it is effective to narrow the widths of the closure domains. As an invention following this technical idea, for example, Patent Document 3 discloses a method in which strong strain is formed in a narrow region using a $TEM_{00}$ mode laser beam having an excellent focusability, and narrow closure domains having a sufficient intensity are obtained.

Meanwhile, in a laser irradiation step in the laser magnetic domain control method, the magnetic domains are controlled by forming an insulation film on a glass film, and radiating a laser beam above the insulation film. However, in this method, there have been cases in which the irradiation of a laser beam increases the temperature, and the increase in the temperature generates flaws in the insulation film and the glass film. Here, the flaws refer to film damage such as the exfoliation, uplift, property change, and color change of the insulation film and the glass film. In a case in which flaws are generated in the glass film, the metal section below the film becomes exposed to the outside, and there is a concern that rust may be generated. Therefore, in a case in which flaws are generated in the glass film, it is necessary to apply the insulation film again. In such a case, the addition of a step increases the manufacturing costs.

In the manufacture of the grain-oriented electrical steel sheet, a number of thermal treatments are carried out, and thus there are cases in which the interface structure or thickness of the glass film or the insulation film becomes uneven in the rolling direction and the width direction of the metal section of the steel sheet. As a result, there have been cases in which, even when the laser conditions are adjusted, it is difficult to suppress the generation of flaws in the glass film throughout the entire steel sheet.

PATENT CITATION

[Patent Document 1] Japanese Unexamined Patent Application, First Publication No. 2007-119821

[Patent Document 2] Japanese Unexamined Patent Application, First Publication No. S59-33802

[Patent Document 3] Pamphlet of International Publication No. WO2004/083465

[Patent Document 4] Japanese Examined Patent Application, Second Publication No. H1-51527

SUMMARY OF THE INVENTION

Problems to be Solved by the Invention

As described above, to efficiently manufacture a grain-oriented electrical steel sheet having low core loss, it is necessary to suppress the generation of flaws in a glass film, and to form narrow closure domains having a sufficient intensity in a metal section of the steel sheet. However, the suppression of the generation of flaws and the formation of the closure domains are conflicting concepts. That is, to form narrow and deep closure domains, it is effective to increase the gradient of a temperature distribution with respect to the sheet thickness direction which is formed near the outermost layer of the steel sheet during the scanning and irradiation of a laser. However, when the temperature gradient is great, the temperature at a laser beam-irradiated section on the steel sheet surface becomes high, and thus a risk of flaws being generated in the glass film increases. There is a demand for optimizing the laser irradiation conditions in consideration of the above-described conflicting relationship, but techniques capable of sufficiently satisfying both requirements have not yet been found.

For example, when magnetic domains are controlled using the $TEM_{00}$ mode laser beam disclosed in Patent Document 3, it is possible to form narrow closure domains having a sufficient intensity due to the high focusability, which is the characteristic of the $TEM_{00}$ mode, and a temperature distribution in which the temperature becomes high in the middle section. Meanwhile, in this method, since the beam intensity is high near the center, compared with a case in which the $TEM_{00}$ mode is not used, there has been a problem in that flaws are likely to be generated. As a method for suppressing the generation of the above-described flaws, for example, Patent Document 4 discloses a method in which the beam is provided with an elliptic shape that is long in the scanning direction of the laser beam. However, according to the method in which the laser beam having the above-described elliptic shape is used, while the generation of flaws is suppressed, the heating time becomes long. Therefore, there has been a tendency that the widths of the closure domains become great due to the influence of thermal conduction in a direction perpendicular to the scanning direction of the laser beam, and there has been a problem that the reduction of the core loss is difficult.

The present invention has been made in consideration of the above-described problems. An object of the present invention is to provide a laser processing apparatus and a laser irradiation method in which it is possible to suppress the generation of flaws in a glass film while reducing the core loss of a grain-oriented electrical steel sheet.

Methods for Solving the Problem (1) That is, according to an aspect of the present invention, there is provided a laser processing apparatus for reducing a magnetic domain size of a grain-oriented electrical steel sheet by focusing a laser beam on the grain-oriented electrical steel sheet and scanning the grain-oriented electrical steel sheet in a scanning direction with the laser beam, including a laser oscillator emitting the laser beam; and a laser irradiation unit applying the laser beam transmitted from the laser oscillator to the grain-oriented electrical steel sheet, in which, the laser irradiation unit has a structure providing an intensity distribution of the laser beam focused on the grain-oriented electrical steel sheet on a cross-section in a direction perpendicular to the scanning direction on the grain-oriented electrical steel sheet so as to satisfy $Ib/Ia \leq 2$, where, when the integral of the intensity distribution is calculated from the centroid of the intensity distribution in each of the first direction and the second direction which are both perpendicular to the scanning direction, $Ra_1$ is the distance between the centroid of the intensity distribution and a position at which the intensity integration value from the centroid of the intensity distribution in the first direction is 43% of the total intensity integration value, $Ra_2$ is the distance between the centroid of the intensity distribution and a position at which the intensity integration value from the centroid of the intensity distribution in the second direction is 43% of the total intensity integration value, a beam intensity $Ia_1$ is the intensity corresponding to $Ra_1$, the beam intensity $Ia_2$ is the intensity corresponding to $Ra_2$, Ia is the average value of the beam intensity $Ia_1$ and the beam intensity $Ia_2$ and Ib is the beam intensity of the laser beam at the centroid of the intensity distribution.

(2) In the laser processing apparatus according to (1), furthermore, the structure of the laser irradiation unit provides a C direction intensity distribution of the laser beam focused on the grain-oriented electrical steel sheet on a cross-section in the scanning direction on the grain-oriented electrical steel sheet so as to satisfy $1.5 \leq Id/Ic \leq 10$, where, when the integral of the C direction intensity distribution is calculated from the centroid of the C direction intensity distribution in each of the third direction and the fourth direction which are both along the scanning direction, $Rc_1$ is the distance between the centroid of the C direction intensity distribution and a position at which the intensity integration value from the centroid of the C direction intensity distribution in the third direction is 43% of the total C direction intensity integration value, $Rc_2$ is the distance between the centroid of the C direction intensity distribution and a position at which the intensity integration value from the centroid of the C direction intensity distribution in the fourth direction is 43% of the total C direction intensity integration value, a beam intensity $Ic_1$ is the intensity corresponding to $Rc_1$, a beam intensity $Ic_2$ is the intensity corresponding $Rc_2$, Ic is the average value of the beam intensity $Ic_1$ and the beam intensity $Ic_2$ and Id is the beam intensity of the laser beam at the centroid of the C direction intensity distribution.

(3) In the laser processing apparatus according to (1) or (2), Ib/Ia may be within a range of 1.0 to 2.0.

(4) In the laser processing apparatus according to any one of (1) to (3), when the average value of $Ra_1$ and $Ra_2$ is represented by Ra, Ra may be within a range of 5 μm to 100 μm.

(5) In the laser processing apparatus according to (4), Ra may be within a range of 5 μm to 60 μm.

(6) In the laser processing apparatus according to any one of (1) to (5), when a wavelength of the laser beam is represented by λ in units of μm, a beam parameter product of the laser beam focused on the grain-oriented electrical steel sheet may be within a range of λ/π to 10 mm·mrad.

(7) In the laser processing apparatus according to any one of (1) to (6), the laser oscillator may be a fiber laser or a disc laser.

(8) In the laser processing apparatus according to any one of (1) to (7), a spot shape of the laser beam focused on the grain-oriented electrical steel sheet may be an ellipse, and a short axis direction of the ellipse may be perpendicular to the scanning direction.

(9) According to another aspect of the present invention, there is provided a laser irradiation method including a laser irradiation step for decreasing a magnetic domain size of a grain-oriented electrical steel sheet by focusing a laser beam on the grain-oriented electrical steel sheet and scanning the grain-oriented electrical steel sheet in a scanning direction with the laser beam, in which, Ib/Ia is 2.0 or less in the intensity distribution of the laser beam focused on the grain-oriented electrical steel sheet on a cross-section in a direction perpendicular to the scanning direction on the grain-oriented electrical steel sheet, where, when the integral of the intensity distribution is calculated from the centroid of the intensity distribution in each of the first direction and the second direction which are both perpendicular to the scanning direction, $Ra_1$ is the distance between the centroid of the intensity distribution and a position at which the intensity integration value from the centroid of the intensity distribution in the first direction is 43% of the total intensity integration value, $Ra_2$ is the distance between the centroid of the intensity distribution and a position at which the intensity integration value from the centroid of the intensity distribution in the second direction is 43% of the total intensity integration value, a beam intensity Ia is the intensity corresponding to $Ra_1$, the beam intensity $Ia_2$ is the intensity corresponding to $Ra_2$, Ia is the average value of the beam intensity $Ia_1$ and the beam intensity $Ia_2$ and Ib is the beam intensity of the laser beam at the centroid of the intensity distribution.

(10) In the laser irradiation method according to (9), furthermore, Id/Ic falls within a range of 1.5 to 10 in a C direction intensity distribution of the laser beam focused on the grain-oriented electrical steel sheet on a cross-section in the scanning direction on the grain-oriented electrical steel sheet, where, when the integral of the C direction intensity distribution is calculated from the centroid of the C direction intensity distribution in each of the third direction and the fourth direction which are both along the scanning direction, $Rc_1$ is the distance between the centroid of the C direction intensity distribution and a position at which the intensity integration value from the centroid of the C direction intensity distribution in the third direction is 43% of the total C direction intensity integration value, $Rc_2$ is the distance between the centroid of the C direction intensity distribution and a position at which the intensity integration value from the centroid of the C direction intensity distribution in the fourth direction is 43% of the total C direction intensity integration value, a beam intensity $Ic_1$ is the intensity corresponding to $Rc_1$, a beam intensity $Ic_2$ is the intensity corresponding $Rc_2$, Ic is the average value of the beam intensity $Ic_1$ and the beam intensity $Ic_2$ and Id is the beam intensity of the laser beam at the centroid of the C direction intensity distribution.

Effects of the Invention

According to the above-described aspects of the present invention, it becomes possible to suppress the generation of flaws in a glass film while reducing the core loss of a grain-oriented electrical steel sheet.

DETAILED DESCRIPTION OF THE INVENTION

Hereinafter, embodiments of the present invention will be described in detail with reference to the accompanying drawings. In the present specification and the drawings, components having substantially the same constitution and function will be given the same reference symbol, and will not be repeatedly described.

<Overview of a Grain-Oriented Electrical Steel Sheet>

A grain-oriented electrical steel sheet refers to an electrical steel sheet in which the easy magnetization axes (in a <100> direction of a body-centered cubic crystal) of crystal grains in the steel sheet substantially align along a rolling direction in a manufacturing step. The grain-oriented electrical steel sheet has a structure in which magnetic domains magnetized in the rolling direction are arrayed in multiple rows with a magnetic wall interposed therebetween. The grain-oriented electrical steel sheet is easily magnetized in the rolling direction, and is thus suitable for a core material of a transformer in which the directions of the magnetic lines of force are almost constant.

Figure 1:
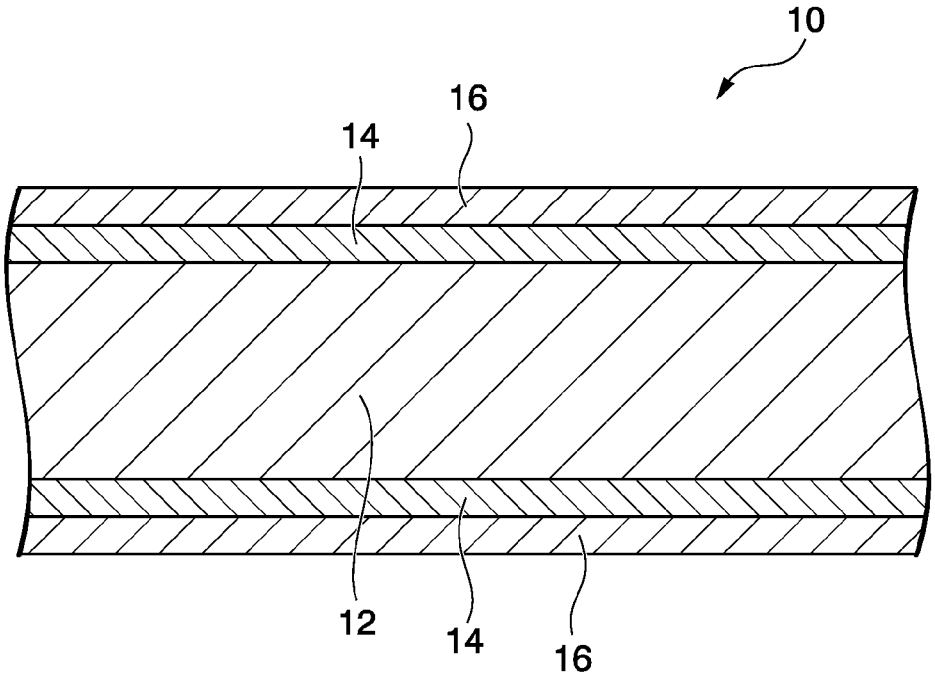
FIG. 1 is a cross-sectional view of a grain-oriented electrical steel sheet 10 according to the present embodiment.

FIG. 1 is a cross-sectional view of a grain-oriented electrical steel sheet 10 according to the present embodiment. As shown in FIG. 1, the grain-oriented electrical steel sheet 10 includes a base steel sheet (metal section) 12, glass films 14 formed on both surfaces of the base steel sheet 12, and insulation films 16 formed on the glass films 14. Transformers are roughly classified into laminated core transformers and toroidal transformers. For the toroidal transformers, a steel sheet is changed toroidally in shape by a bending deformation so as to have a transformer shape, and then is annealed to remove strain introduced due to the mechanical deformation (stress-relief annealing step). In this annealing step, even strain introduced by the laser irradiation as described above is released, and the magnetic domain refinement effect is lost. Meanwhile, in the manufacture of the laminated core transformers, the strain-relief annealing step is not required. Therefore, the grain-oriented electrical steel sheet 10 according to the present embodiment is particularly suitable as a material for the laminated core transformers.

The base steel sheet 12 is constituted of an iron alloy containing Si. An example of the chemical composition of the base steel sheet 12 is Si: 2.5 mass % to 4.0 mass %, C: 0.02 mass % to 0.10 mass %, Mn: 0.05 mass % to 0.20 mass %, acid-soluble Al: 0.020 mass % to 0.040 mass %, N: 0.002 mass % to 0.012 mass %, S: 0.001 mass % to 0.010 mass %, and P: 0.01 mass % to 0.04 mass % with the balance of Fe and impurities. The thickness of the base steel sheet 12 is, for example, within a range of 0.2 mm to 0.3 mm.

The glass film 14 is constituted of a multiple oxide, for example, forsterite ($Mg_2SiO_4$), spinel ($MgAl_2O_4$), or cordierite ($Mg_2Al_4Si_5O_{16}$). The thickness of the glass film 14 is, for example, 1 μm.

The insulation film 16 is formed by, for example, baking a coating solution mainly including colloidal silica and a phosphate (magnesium phosphate, aluminum phosphate, or the like) or a coating solution that is a mixture of an alumina sol and boric acid. The thickness of the insulation film 16 is, for example, within a range of 2 μm to 3 μm.

In the grain-oriented electrical steel sheet 10 in the above-described constitution, a laser beam is focused, is emitted above the insulation film 16, and the grain-oriented electrical steel sheet is scanned substantially in a width direction (a direction substantially orthogonal to a rolling direction) of the grain-oriented electrical steel sheet being transported in the rolling direction (transportation direction) with the laser beam. Temperature gradients in the sheet thickness direction and the sheet width direction, which are caused by the irradiation of the laser beam, impart residual strain in linear regions almost orthogonal to the rolling direction. The linear regions imparted with the residual strain are generated in predetermined periods in the rolling direction, and in regions which are interposed between two linear regions and are magnetized in the rolling direction, the magnetic domain widths in a direction substantially orthogonal to the rolling direction are reduced.

Hereinafter, in some cases, the above-described grain-oriented electrical steel sheet will be referred to as the grain-oriented electrical steel sheet according to the present embodiment.

<Method for Manufacturing the Grain-Oriented Electrical Steel Sheet>

Figure 2:
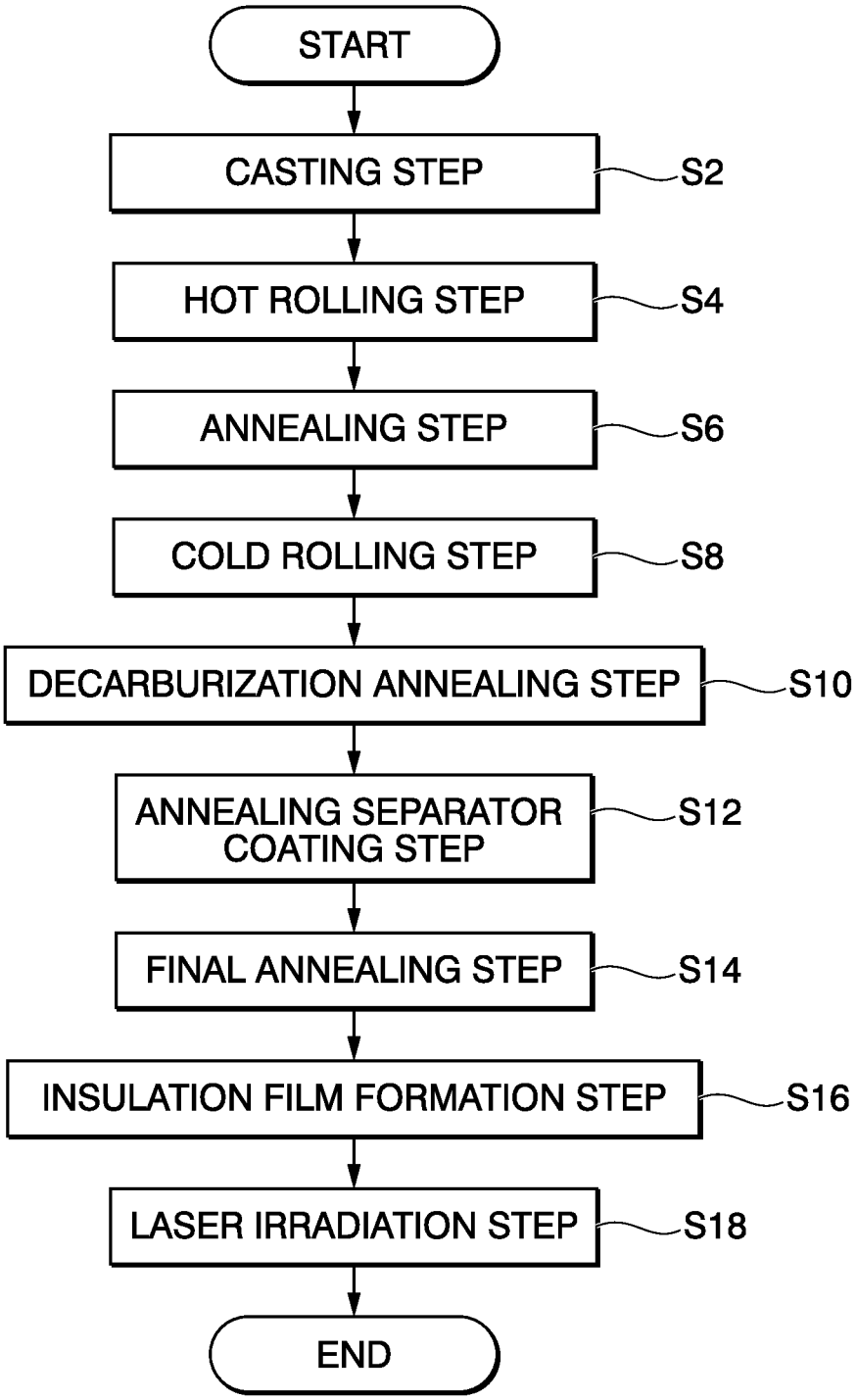
FIG. 2 is a flowchart showing an example of a step for manufacturing the grain-oriented electrical steel sheet 10 according to the present embodiment.

A method for manufacturing the grain-oriented electrical steel sheet 10 according to the present embodiment will be described with reference to FIG. 2. FIG. 2 is a flowchart showing an example of a step for manufacturing the grain-oriented electrical steel sheet 10 according to the present embodiment.

The step for manufacturing the grain-oriented electrical steel sheet 10, as shown in FIG. 2, includes a casting step S2, a hot rolling step S4, an annealing step S6, a cold rolling step S8, a decarburization annealing step S10, an annealing separator coating step S12, a final annealing step S14, an insulation film formation step S16, and a laser irradiation step S18.

In the casting step S2, molten steel adjusted to have a predetermined composition is supplied to a continuous casting machine, and a slab is continuously formed. In the hot rolling step S4, the slab is heated to a predetermined temperature (for example, 1150° C. to 1400° C.), and is hot-rolled. As a result, a hot-rolled sheet having a predetermined thickness (for example, 1.8 mm to 3.5 mm) is obtained.

In the annealing step S6, a thermal treatment (annealing) is carried out on the hot-rolled sheet under conditions of, for example, a heating temperature within a range of 750° C. to 1200° C. and a heating time within a range of 30 seconds to 10 minutes. In the cold rolling step S8, the surface of the hot-rolled sheet is pickled, and then cold rolling is carried out. As a result, a cold-rolled sheet having a predetermined thickness (for example, 0.15 mm to 0.35 mm) is obtained.

In the decarburization annealing step S10, a thermal treatment (decarburization annealing) is carried out on the cold-rolled sheet under conditions of, for example, a heating temperature within a range of 700° C. to 900° C. and a heating time within a range of 1 minute to 3 minutes, thereby obtaining the base steel sheet 12. According to the decarburization annealing step, an oxide layer mainly including silica ($SiO_2$) forms on the surface of the base steel sheet 12. In the annealing separator coating step S12, an annealing separator mainly including magnesia (MgO) is applied onto the oxide layer on the surface of the base steel sheet 12.

In the final annealing step S14, the base steel sheet 12 onto which the annealing separator has been applied is coiled in a coil shape, is put into a batch-type furnace, and a thermal treatment (final annealing) is carried out. The thermal treatment conditions are, for example, a heating temperature within a range of 1100° C. to 1300° C. and a heating time within a range of 20 hours to 24 hours. At this time, so-called Goss grains which have easy magnetization axes in the transportation direction (rolling direction) of the base steel sheet 12 preferentially grow. As a result, a grain-oriented electrical steel sheet having a high crystal orientation (crystal alignment) is obtained after the final annealing. In addition, in the final annealing step S14, the oxide layer and the annealing separator react to each other, and the glass film 14 made of forsterite ($Mg_2SiO_4$) forms on the surface of the base steel sheet 12.

In the insulation film formation step S16, the base steel sheet 12 which has been coiled in a coil shape is uncoiled, is stretched in a sheet shape, and is transported. In addition, an insulating material is applied onto the glass films 14 formed on both surfaces of the base steel sheet 12, and is baked, thereby forming the insulation films 16. The base steel sheet 12 on which the insulation films 16 are formed is coiled in a coil shape.

In the laser irradiation step S18, the base steel sheet 12 which has been coiled in a coil shape is uncoiled, is stretched in a sheet shape, and is transported. In addition, a laser beam is focused and a single surface of the base steel sheet 12 is irradiated with the laser beam using a laser irradiation unit according to the present embodiment described below, and the grain-oriented electrical steel sheet is scanned substantially in a width direction (a direction substantially orthogonal to the rolling direction) of the grain-oriented electrical steel sheet being transported in the rolling direction (transportation direction) with the laser beam. Therefore, linear strain almost orthogonal to the rolling direction is formed on the surface of the base steel sheet 12 at predetermined intervals in the rolling direction. The focusing and scanning of the laser beam may be carried out only on the front or back surface of the base steel sheet 12, or may be carried out on both the front and back surfaces. In addition, in the above description, it is described that the base steel sheet 12 on which the insulation films 16 are formed is coiled in a coil shape, and then is sent to the laser irradiation step S18, but it is also possible to carry out the laser irradiation immediately after the formation of the insulation films, and then coil the base steel sheet in a coil shape.

As described above, the glass films 14 and the insulation films 16 are formed on the surfaces of the base steel sheet 12, and are irradiated with the laser beam, thereby manufacturing the grain-oriented electrical steel sheet 10 in which magnetic domains are controlled.

<Constitution of the Laser Processing Apparatus>

Figure 3:
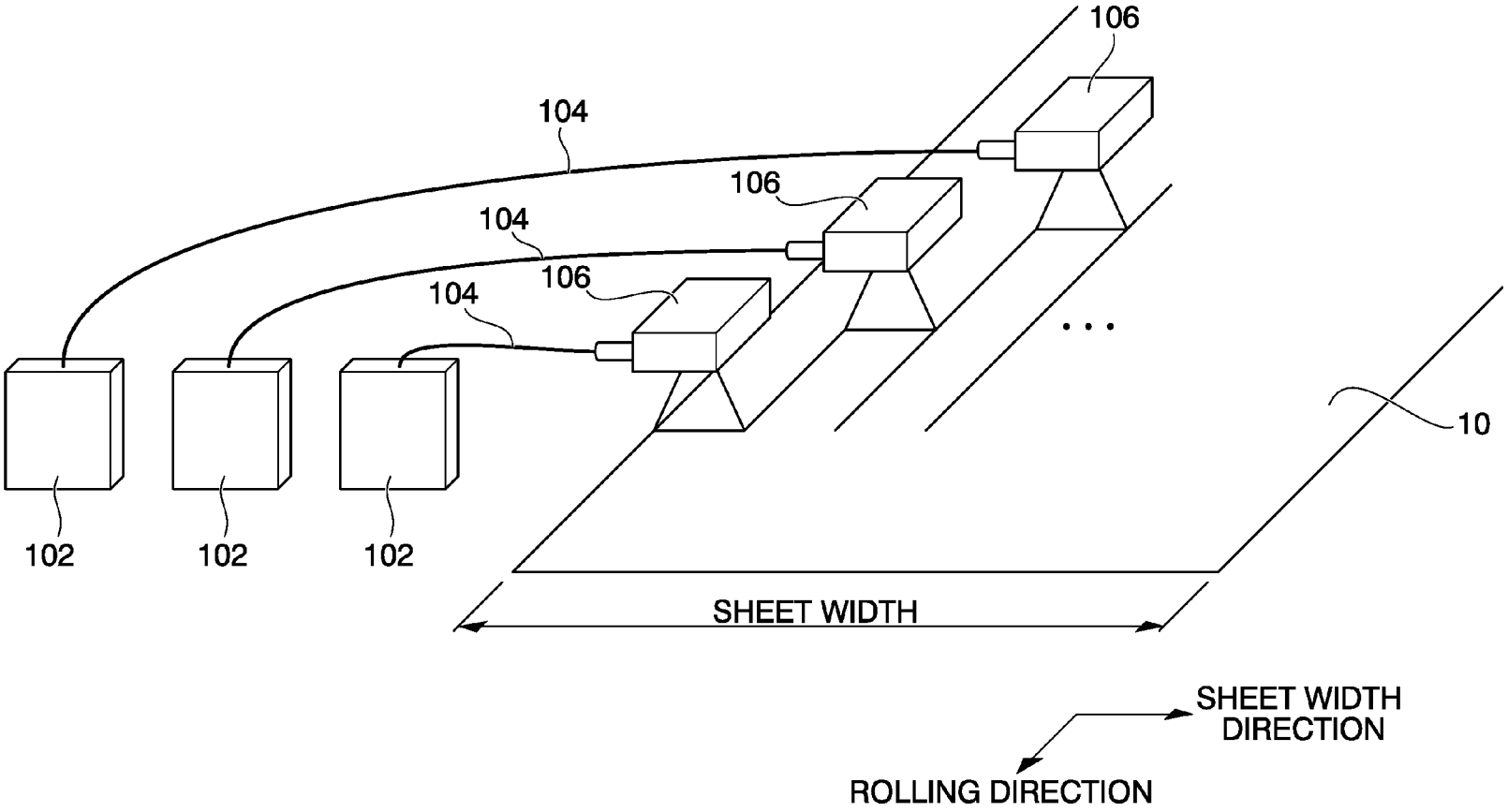
FIG. 3 is a schematic view showing a constitution of an example of a laser processing apparatus 100 according to the present embodiment.
Figure 4:
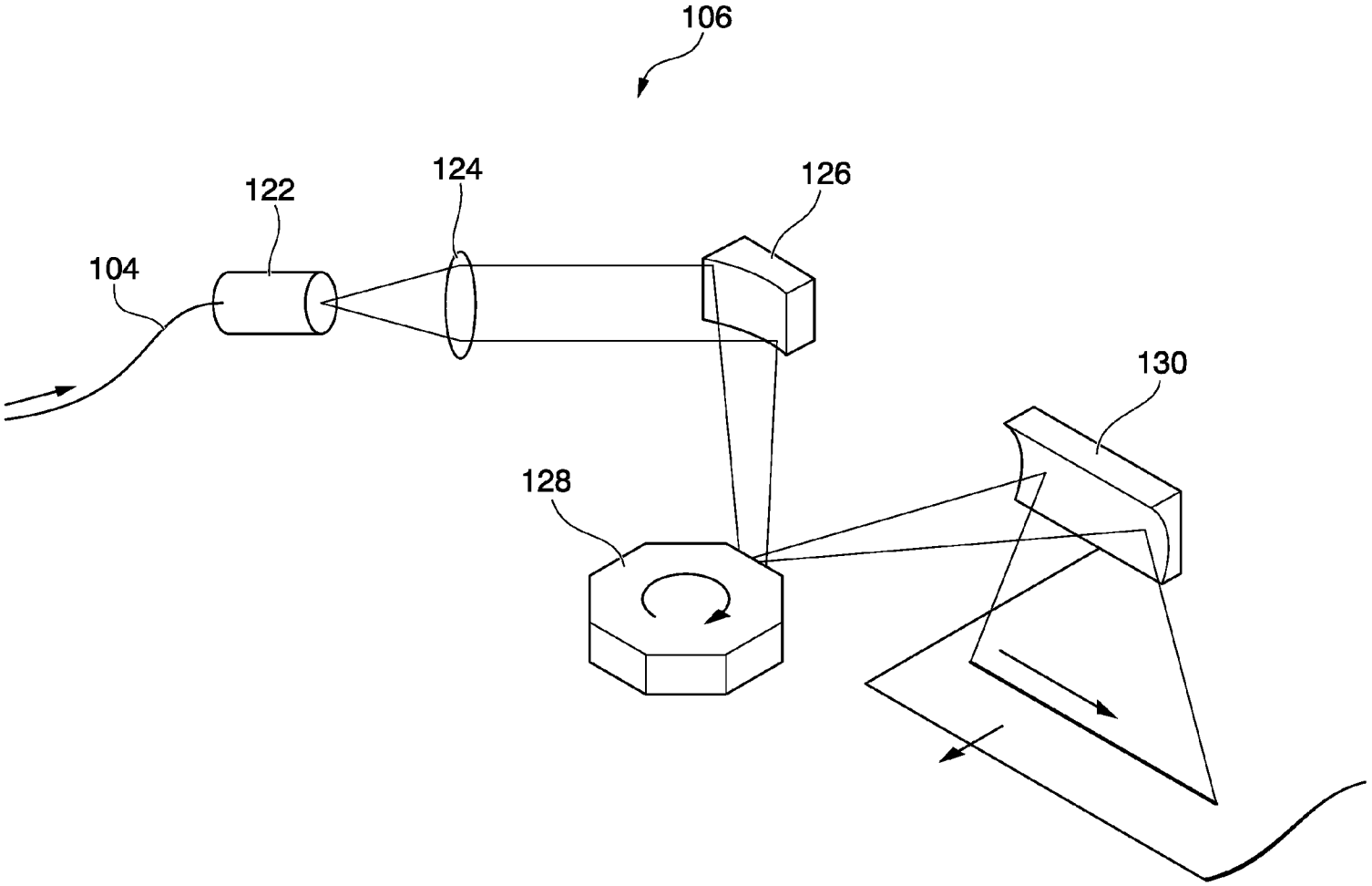
FIG. 4 is a schematic view showing a constitution of an example of a laser irradiation unit 106 according to the present embodiment.

With reference to FIGS. 3 and 4, a constitution of an example of the laser processing apparatus 100 (hereinafter, in some cases, referred to as the laser processing apparatus according to the present embodiment) that irradiates the grain-oriented electrical steel sheet 10 with a laser beam according to the present embodiment so as to impart the residual strain will be described. The laser processing apparatus 100 according to the present embodiment is used to irradiate the grain-oriented electrical steel sheet 10 with a laser beam in the laser irradiation step S18. FIG. 3 is a schematic view showing a constitution of an example of the laser processing apparatus 100 according to the present embodiment.

The laser processing apparatus 100 emits a laser beam above the insulation film 16 in the grain-oriented electrical steel sheet 10 being transported in the rolling direction at a certain speed, thereby imparting linear strain almost orthogonal to the rolling direction. The laser processing apparatus 100, as shown in FIG. 3, includes a plurality of laser oscillators 102, a plurality of transmission fibers 104, and a plurality of laser irradiation units 106. In FIG. 3, three laser oscillators 102, three transmission fibers 104, and three laser irradiation units 106 are shown, and the respective constitutions are the same. In the present embodiment, a case in which three laser oscillators, three transmission fibers, and three laser irradiation units are provided will be described, but the number of the units is not limited as long as the steel sheet can be scanned with the laser beam throughout the entire sheet width.

FIG. 4 is a schematic view shown a constitution of an example of the laser irradiation unit 106.

The laser oscillator 102 emits, for example, a high-output laser beam. The transmission fiber 104 is an optical fiber that transmits a laser beam emitted from the laser oscillator 102 to the laser irradiation unit 106.

Regarding the type of the laser oscillator 102, from the viewpoint of an excellent focusability and a capability of forming narrow closure domains, a fiber laser or a disc laser is preferred. The fiber laser or the disc laser has a wavelength in a near-ultraviolet to near-infrared range (for example, a 1 μm band), and is thus capable of transmitting a laser beam using an optical fiber. When a laser beam is transmitted using an optical fiber, a more compact laser processing apparatus 100 can be realized. In addition, when the laser beam from the fiber laser or the disc laser is transmitted using an optical fiber, compared with a $CO_2$ laser or an YAG laser incapable of transmitting a laser beam using an optical fiber, it becomes easier to control the beam intensity distribution at a position of the spot described below, which is preferable. In addition, the laser oscillator 102 may be a continuous wave laser or a pulse laser.

In a portion which is irradiated with the laser beam in the grain-oriented electrical steel sheet 10, it is necessary to ensure a depth of focus to appropriately form magnetic domains in a case in which the vibration or the like of a steel sheet surface in a direction perpendicular to the steel sheet surface is generated. To ensure the depth of focus, as described below, the beam quality parameter product of the laser beam is preferably 10 (mm·mrad) or less. When the fiber laser or the disc laser is used as the laser oscillator 102, it is possible to set the beam quality parameter product within the above-described range.

A method for quantitatively evaluating the beam qualities will be described. The spot radius of the laser beam and the depth of focus of the laser beam are dependent on the beam qualities. The beam qualities are generally quantified using a beam parameter product (BPP).

Figure 5:
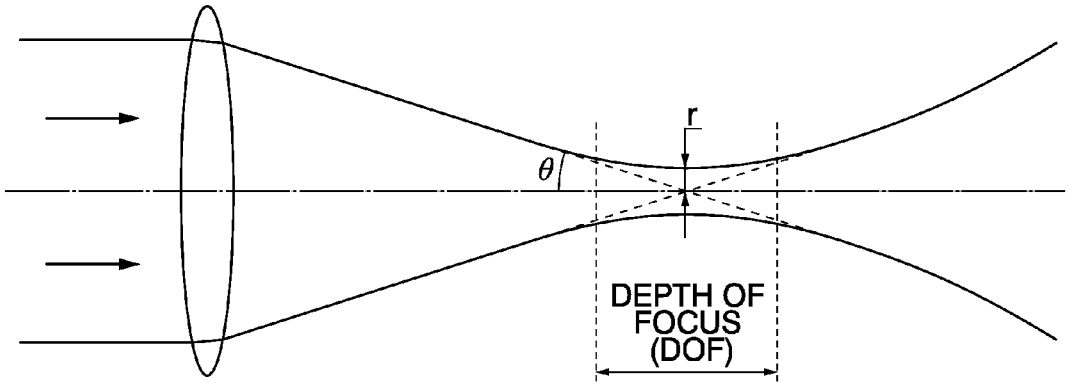
FIG. 5 is a schematic view showing a beam parameter product (BPP).

FIG. 5 is a schematic view showing the beam parameter product (BPP). In FIG. 5, the laser beam that has passed through a lens is focused to a beam diameter with a radius r, and then is enlarged again. In addition, the laser beam is focused at an angle θ. In this case, the beam parameter product (BPP) is expressed by Equation (1) described below in units of mm·mrad.

$$BPP = r \times \theta \quad (1)$$

In addition, in this case, the depth of focus (DOF) is expressed by Equation (2) described below using BPP in units of mm.

$$DOF = 2000 \times r^2 / BPP \quad (2)$$

Here, it is found that, when BPP is set to 10 (mm·mrad) or less, even in a case in which r is set to 0.06 mm to obtain a narrower closure domain width, it is possible to ensure a DOF of 0.7 mm or more. When a DOF of 0.7 mm or more is ensured, even in a case in which the grain-oriented electrical steel sheet 10 vibrates in a direction perpendicular to the sheet surface, it is effective to appropriately reduce magnetic domain size. The lower limit value of BPP is $\lambda/\pi$ (mm·mrad) when the wavelength of the laser beam is λ (μm).

The description will be continued with reference back to FIG. 3. The laser irradiation unit 106 focuses the laser beam transmitted from the laser oscillator 102 using the transmission fiber 104 on the grain-oriented electrical steel sheet 10 and scans the grain-oriented electrical steel sheet 10 with the focused laser beam. The width to be scanned with the laser beam by the laser irradiation unit 106 may be narrower than the sheet width of the grain-oriented electrical steel sheet 10. When the laser irradiation units 106 are arrayed in multiple rows in the sheet width direction as shown in FIG. 3, it is possible to scan the entire sheet width of the grain-oriented electrical steel sheet 10 with the laser beam.

The laser irradiation unit 106, as shown in FIG. 4, includes a laser head 122, a collimator lens 124, a metal mirror 126, a polygon mirror 128, and a paraboloid mirror 130.

The laser head 122 emits the laser beam transmitted using the transmission fiber 104 at a predetermined divergence angle. The collimator lens 124 alters the laser beam emitted from the laser head 122 to a collimated beam.

The metal mirror 126 is a mirror to reduce and adjust the beam diameter of the incident laser beam in the sheet width direction (refer to FIG. 3) of the grain-oriented electrical steel sheet 10. As the metal mirror 126, it is possible to use, for example, a columnar mirror or a paraboloid mirror which has curvature in a single axis direction. The laser beam reflected on the metal mirror 126 is incident on the polygon mirror 128 rotating at a predetermined rotation speed.

The polygon mirror 128 is a rotatable polyhedron, and moves the laser beam in the sheet width direction of the grain-oriented electrical steel sheet 10 by being rotated. While the laser beam is incident on one surface of the polyhedron of the polygon mirror 128, a linear region is scanned with the laser beam substantially in a sheet width direction on the grain-oriented electrical steel sheet 10 in accordance with the rotation of the surface. As a result, residual strain is imparted to the linear region. In accordance with the rotation of the polygon mirror 128, scanning is repeated with the laser beam, and simultaneously, the grain-oriented electrical steel sheet 10 is transported in the rolling direction. As a result, regions having linear residual strain are periodically formed on the grain-oriented electrical steel sheet 10 in the rolling direction. Meanwhile, the period of the linear regions in the rolling direction is adjusted using the transportation speed of the grain-oriented electrical steel sheet 10 and the rotation speed of the polygon mirror 128.

The paraboloid mirror 130 is a mirror to reduce and adjust the beam diameter of the laser beam reflected on the polygon mirror 128 in the rolling direction. The laser beam reflected by the paraboloid mirror 130 is focused on the surface of the grain-oriented electrical steel sheet 10.

Figure 6:
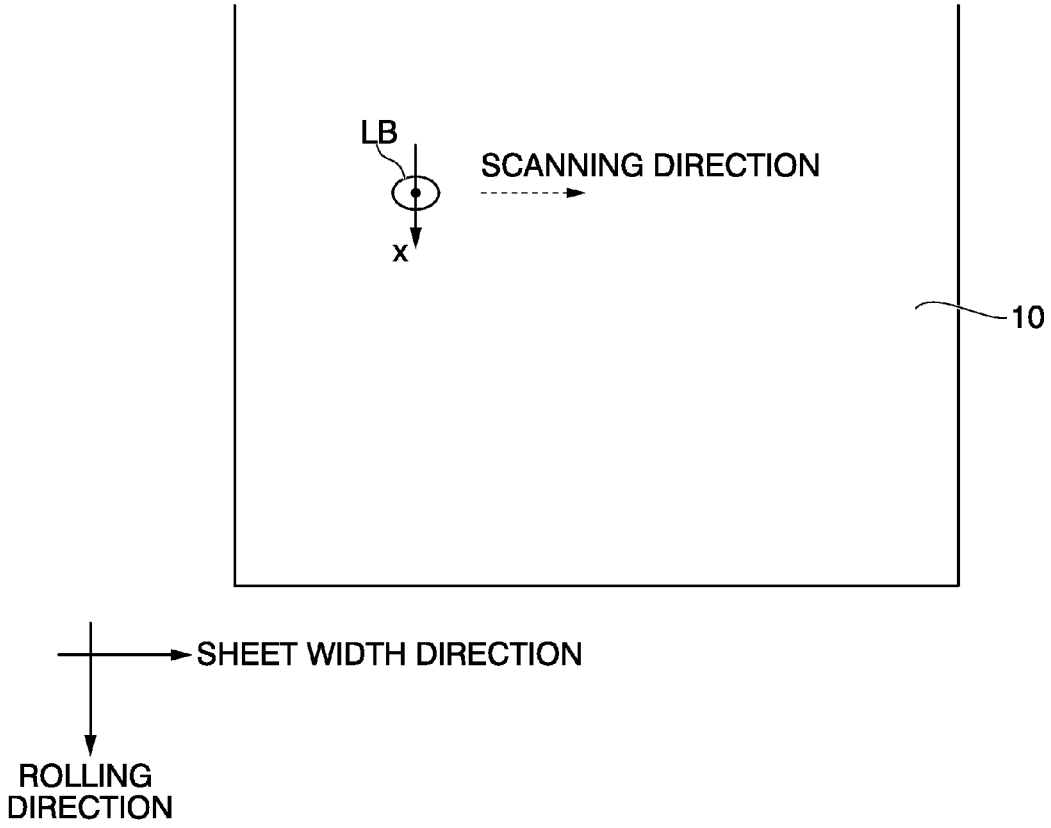
FIG. 6 is a view showing a spot shape of a laser beam on the grain-oriented electrical steel sheet 10.

FIG. 6 is a view showing the spot shape of the laser beam on the grain-oriented electrical steel sheet 10. In the present embodiment, the spot shape of the laser beam is an elliptical shape as shown in FIG. 6, and has a long axis along the scanning direction of the laser beam LB (the long axis and the scanning direction of the laser beam LB are almost parallel to each other) and a short axis substantially orthogonal to the scanning direction (that is, almost 90°, and cases of being not strictly 90° are also included). When the spot shape is set to an elliptical shape as described above, the heating time by the irradiation with the laser beam at one point on the steel sheet becomes long. As a result, the temperatures at deep positions inside the grain-oriented electrical steel sheet 10 can be increased, and the core loss can be effectively reduced. Regarding a spot shape of the laser beam, an elliptical spot can be obtained by reducing the beam diameter in the scanning direction of the laser beam LB using the metal mirror 126, and reducing the beam diameter in a direction orthogonal to the scanning direction using the paraboloid mirror 130. In a case in which the grain-oriented electrical steel sheet 10 is scanned with the laser beam LB in the width direction while the grain-oriented electrical steel sheet is transported in the rolling direction, the scanning direction seen from the laser irradiation unit 106 and the scanning direction seen from the grain-oriented electrical steel sheet 10 are different from each other. The scanning direction of the laser beam LB in the present embodiment refers to the scanning direction seen from the grain-oriented electrical steel sheet 10.

In the above description, the spot shape of the laser beam on the grain-oriented electrical steel sheet 10 is set to an elliptical shape, but is not limited thereto. For example, the spot shape of the laser beam may be an exact circle shape.

In addition, in the above description, the laser oscillator 102 is the fiber laser or the disc laser, but is not limited thereto. For example, the laser oscillator 102 may be a $CO_2$ laser. In this case, the laser beam is transmitted from the laser oscillator 102 to the laser irradiation unit 106 using a mirror or the like in place of the optical fiber.

<Regarding the Magnetic Domain Refinement and Flaws in the Glass Films>

Meanwhile, the grain-oriented electrical steel sheet 10 to which a magnetic field is applied in the rolling direction, as described above, has a structure in which magnetic domains magnetized in the rolling direction are arrayed in multiple rows. Here, to further reduce the core loss of the grain-oriented electrical steel sheet 10, it is effective to reduce the magnetic domain size (narrow the magnetic domains) by irradiating with the laser beam. To reduce the magnetic domain size, it is particularly effective to form narrower closure domains having a sufficient intensity by imparting a great temperature gradient with respect to the sheet thickness direction to extremely narrow regions along the rolling direction near the outermost layer of the grain-oriented electrical steel sheet 10.

To increase the temperature gradient, it is necessary to increase the temperature of the surface of the grain-oriented electrical steel sheet 10. However, when the temperature of the surface is increased, there are cases in which the temperature increase causes flaws, such as the exfoliation of films, in the insulation film 16 or the glass film 14. Particularly, in a case in which flaws are generated in the glass film 14, the base steel sheet 12 is exposed to the outside, and there is a concern that rust may be generated, which is not desirable.

Therefore, in the present embodiment, to realize both the reduction of the core loss of the grain-oriented electrical steel sheet 10 and the prevention of the generation of flaws in the glass film 14, as described below, the intensity distribution of the laser beam on the surface of the grain-oriented electrical steel sheet 10 is set so that predetermined conditions are satisfied.

<The Intensity Distribution of the Laser Beam on the Surface of the Grain-Oriented Electrical Steel Sheet>

The setting of the intensity distribution of the laser beam on the surface of the grain-oriented electrical steel sheet 10 of the present embodiment will be described with comparison with comparative examples.

Figure 7:
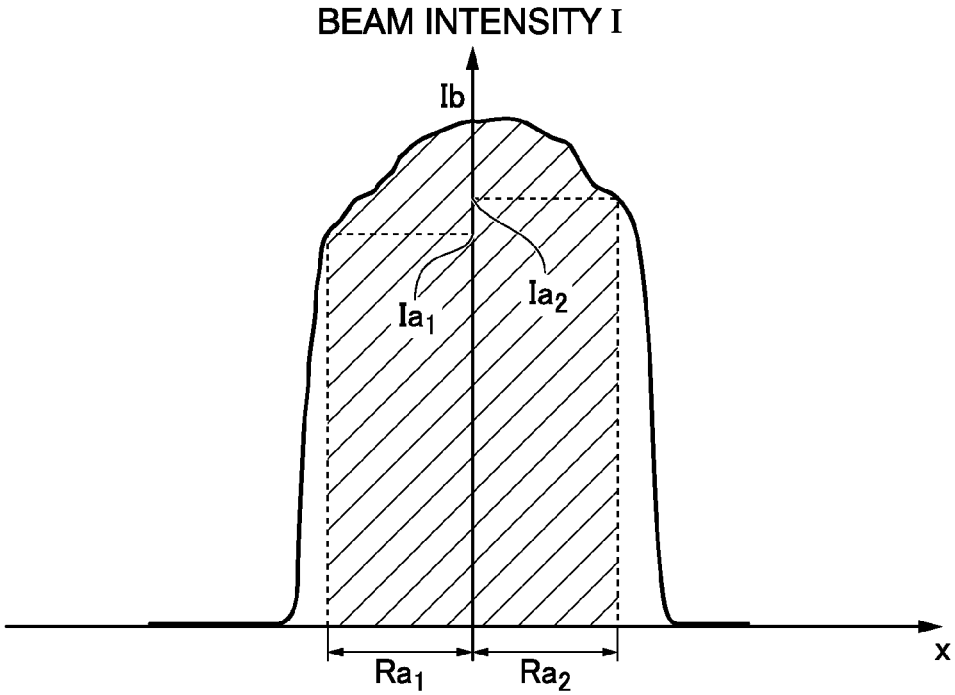
FIG. 7 is a view showing the intensity distribution of a laser beam according to the present embodiment on a cross-section perpendicular to the laser beam scanning direction.
Figure 8:
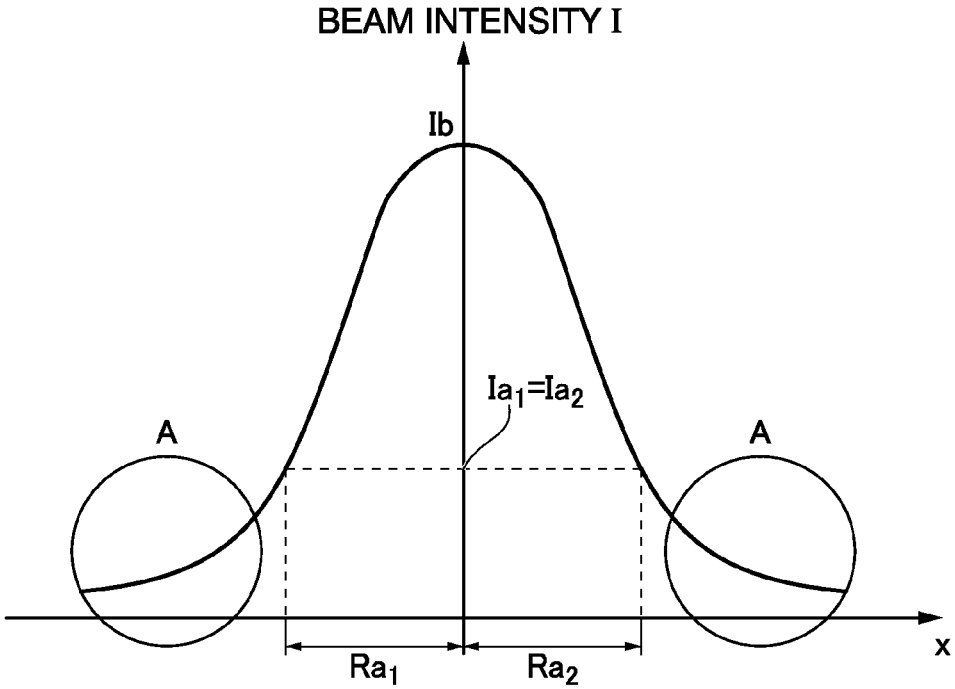
FIG. 8 is a view showing the intensity distribution of the laser beam according to a comparative example on the cross-section perpendicular to the laser beam scanning direction.

FIG. 7 is a view showing the intensity distribution of the laser beam according to the present embodiment. FIG. 8 is a view showing the intensity distribution of the laser beam according to a comparative example. Both FIGS. 7 and 8 show the distributions of the beam intensity I (the output power of the laser beam per unit area) on a cross-section perpendicular to the scanning direction of the laser beam passing through the centroid of the laser beam with respect to the scanning direction. The horizontal axis in FIGS. 7 and 8 indicates the distance x from the centroid of the intensity distribution (the definition of the x axis is shown in FIG. 6). Here, the centroid of the intensity distribution with respect to the scanning direction is defined as, when the scanning direction of the laser beam is defined as the y axis, the centroid position y of the intensity integration value (this integration value serves as a function of y) obtained by the integral of the intensity distribution of the laser beam, which serves as functions of x and y, along the x axis with respect to individual y values. Meanwhile, the comparative example shown in FIG. 8 is an intensity distribution in a case in which a so-called $TEM_{00}$ mode laser beam is focused on the grain-oriented electrical steel sheet 10. The $TEM_{00}$ mode refers to a mode showing the Gaussian distribution in which the maximum beam intensity is present in the central section of the intensity distribution as shown in FIG. 8.

In the case of the comparative example, as shown in FIG. 8, the beam intensity is distributed in a wide range in a direction orthogonal to the scanning direction (the x-axis direction), and wing regions A are present in both sides of the intensity distribution (that is, both sides of the intensity distribution smoothly extend). In a case in which the wing regions A are present as described above, thermal conduction easily occurs from the wing regions A in a direction orthogonal to the scanning direction of the laser beam.

Figure 9:
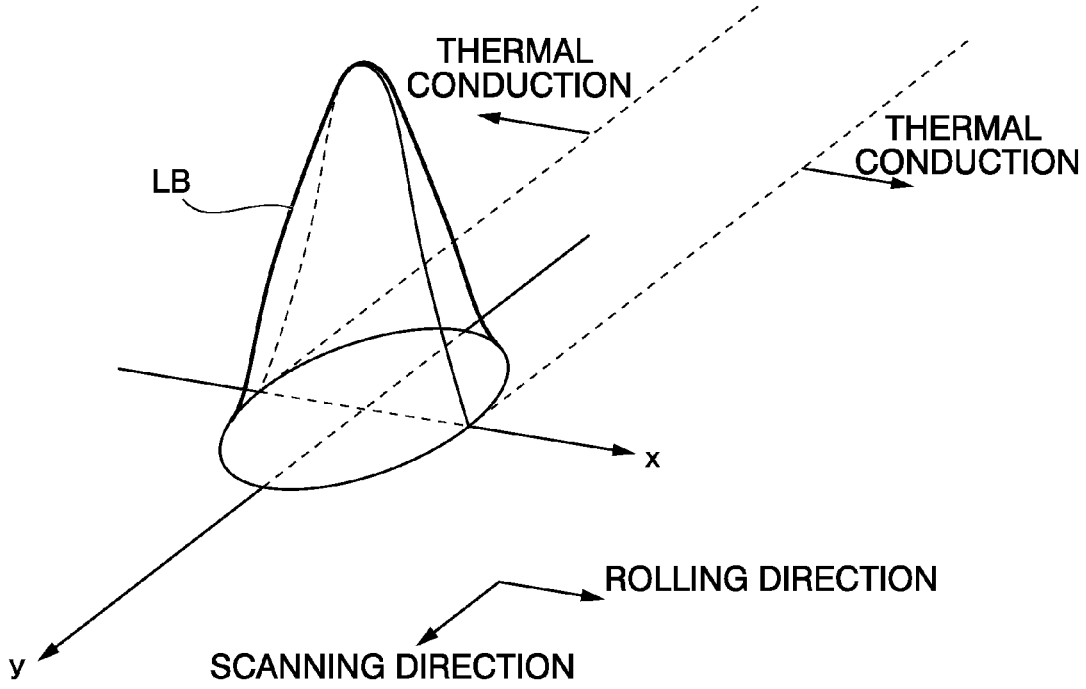
FIG. 9 is a schematic view showing thermal conduction occurring in a direction orthogonal to the scanning direction from each wing region A according to the comparative example.

FIG. 9 is a schematic view showing thermal conduction occurring in a direction orthogonal to the scanning direction from the wing region A in the intensity distribution of the laser beam according to the comparative example. When the laser beam LB is moved in the scanning direction as shown in FIG. 9, thermal conduction occurs in a direction orthogonal to the scanning direction from the wing region A. Therefore, regions in which the temperature increases spread in a wide range in a direction orthogonal to the scanning direction, and the closure domain widths are likely to widen. As a result, the reduction of the core loss of the grain-oriented electrical steel sheet 10 is hindered.

On the contrary, in the case of the intensity distribution of the laser beam according to the present embodiment, as shown in FIG. 7, the widths of the wing regions in the intensity distribution are narrow, and the beam intensity is distributed in a narrow range in a direction orthogonal to the scanning direction. Therefore, the occurrence of thermal conduction in a direction orthogonal to the scanning direction from the wing region is suppressed, and the closure domain widths become narrow. As a result, compared with the comparative example, it becomes possible to further reduce the core loss of the grain-oriented electrical steel sheet 10.

In the intensity distributions of the laser beam shown in FIGS. 7 and 8, distances $Ra_1$ and $Ra_2$, a beam intensity $Ia_1$, a beam intensity $Ia_2$, and a beam intensity Ib are defined as described below. The distance $Ra_1$ represents the distance from the centroid of the intensity distribution to a position on the x axis at which the intensity integration value obtained by the integral of the intensity distribution from the centroid of the intensity distribution in the −x direction (the first direction, the left direction on the paper in FIG. 7) is 43% of the total intensity integration value. In addition, the distance $Ra_2$ represents the distance from the centroid of the intensity distribution to a position on the x axis at which the intensity integration value obtained by the integral of the intensity distribution from the centroid of the intensity distribution in the +x direction (the second direction, the right direction on the paper in FIG. 7) is 43% of the total intensity integration value. That is, in FIG. 7, the area of the hatched region indicated by $Ra_1$ and $Ra_2$ accounts for 86% (43%+43%) of the value obtained by the integral of the entire intensity distribution in FIG. 7 (this definition shall also apply to FIG. 8). In addition, the beam intensity $Ia_1$ represents the beam intensity at the position of the distance $Ra_1$, and the beam intensity $Ia_2$ represents the beam intensity at the position of the distance $Ra_2$. The average value of $Ia_1$ and $Ia_2$ is represented by Ia. Meanwhile, in a case in which the laser beam is bilaterally symmetric, $Ra_1$ and $Ra_2$, and $Ia_1$ and $Ia_2$ become equal. The beam intensity Ib represents the beam intensity at the centroid of the intensity distribution.

In the intensity distribution of the laser beam according to the comparative example shown in FIG. 8, Ib/Ia is 2.8. On the contrary, in the intensity distribution of the laser beam according to the present embodiment shown in FIG. 7, to suppress the peak of the intensity and suppress thermal conduction in a direction orthogonal to the scanning direction, Ib/Ia is set to 2.0 or less, preferably within a range of 1.0 to 2.0. When the intensity distribution of the laser beam on the surface of the grain-oriented electrical steel sheet 10 is set so that Ib/Ia falls within a range of 1.0 to 2.0, the occurrence of thermal conduction is suppressed, and it becomes possible to significantly reduce the core loss.

Ib/Ia can be appropriately adjusted through, in the laser processing apparatus, for example, a change in the type of the laser beam and/or the selection of the metal mirror 126 or the paraboloid mirror 130 having appropriate curvature (focal length).

In addition, in the present embodiment, when the average value of $Ra_1$ and $Ra_2$ is represented by Ra, the intensity distribution of the laser beam is set so that Ra is 100 μm (0.1 mm) or less. Therefore, narrower closure domains are formed while the distance of thermal conduction in a direction orthogonal to the scanning direction is further diminished, and thus it is possible to more significantly reduce the core loss. To reliably reduce the core loss, it is more desirable to set Ra to 60 μm or less. When Ra reaches less than 5 μm, the depth of focus becomes too shallow, which is not desirable.

According to a laser beam having the intensity distribution of the laser beam according to the present embodiment, it is possible to suppress the generation of flaws in the glass film 14. In a case in which the intensity distribution of the laser beam is the Gaussian distribution as shown in FIG. 8, high beam intensity (the beam intensity Ib shown in FIG. 8) appears at the center section of the intensity distribution. In such a case, the beam intensity becoming too high at the center section of the intensity distribution locally increases the temperature on the surface of the grain-oriented electrical steel sheet 10, and there is a concern that flaws may be generated in the glass film 14.

On the contrary, in a case in which the intensity distribution of the laser beam has an intensity distribution as shown in FIG. 7, the beam intensity distribution appears in a substantially rectangular shape, and thus, compared with the comparative example, the beam intensity (the beam intensity Ib shown in FIG. 7) does not become too high at the center section. Therefore, it is possible to reduce a local temperature increase on the surface of the grain-oriented electrical steel sheet 10, and thus it is possible to suppress the generation of flaws in the glass film 14.

Figure 10:
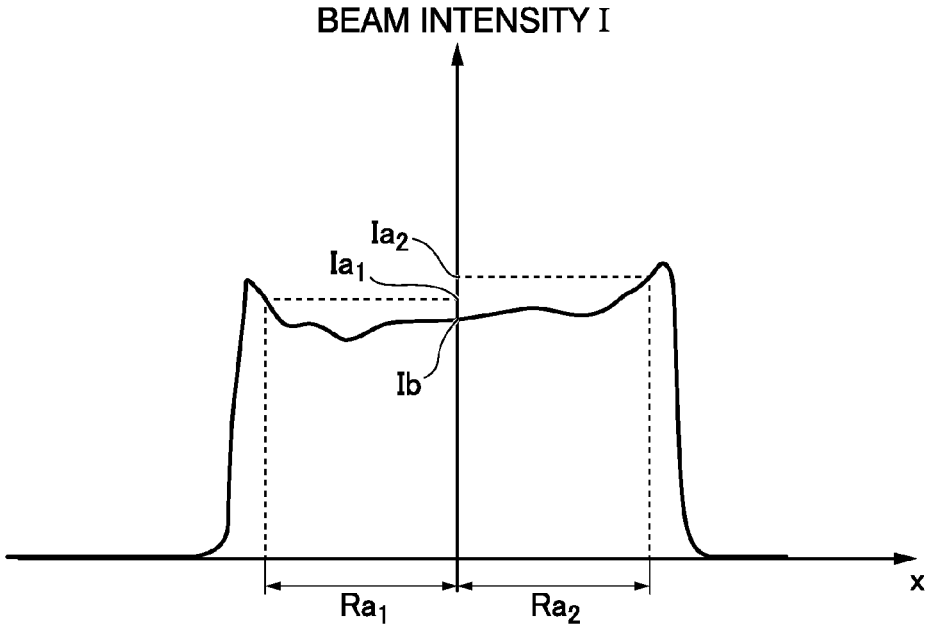
FIG. 10 is a view showing a modified example of the intensity distribution of the laser beam according to the present embodiment.

In the above description, the intensity distribution of the laser beam according to the present embodiment is described to look like a distribution as shown in FIG. 7, but the intensity distribution of the laser beam is not limited thereto. For example, FIG. 10 is a view showing a modified example of the intensity distribution of the laser beam according to the present embodiment. In an intensity distribution as shown in FIG. 10, the beam intensities at both end sections of the distribution are slightly higher than the beam intensity at the center section. Therefore, Ib/Ia becomes less than 1, and therefore 2.0 or less. This intensity distribution shown in FIG. 10 is the same as the intensity distribution shown in FIG. 7 in that no wing regions are present in either side of the intensity distribution. Therefore, similar to the intensity distribution shown in FIG. 7, the distance of thermal conduction in a direction orthogonal to the scanning direction is decreased, and it is possible to significantly reduce the core loss. That is, when Ib/Ia is 2.0 or less, the distance of thermal conduction in a direction orthogonal to the scanning direction is decreased, and it is possible to significantly reduce the core loss. In a case in which the center of the intensity distribution is lower than the edge sections, and Ib/Ia reaches less than 1.0, the temperatures at the edge sections easily increase, and thus there is a tendency that the distance of thermal conduction in a direction orthogonal to the scanning direction becomes great. From this viewpoint, Ib/Ia is desirably 1.0 or more.

In addition, FIGS. 7 to 9 shown above show cases in which the spot shape of the laser beam is an elliptical shape, but the spot shape is not limited thereto. For example, even in a case in which the spot shape of the laser beam is an exact circle shape, when Ib/Ia is set to be 2.0 or less, it is possible to reduce the core loss, and suppress the generation of flaws in the glass film 14.

Figure 11:
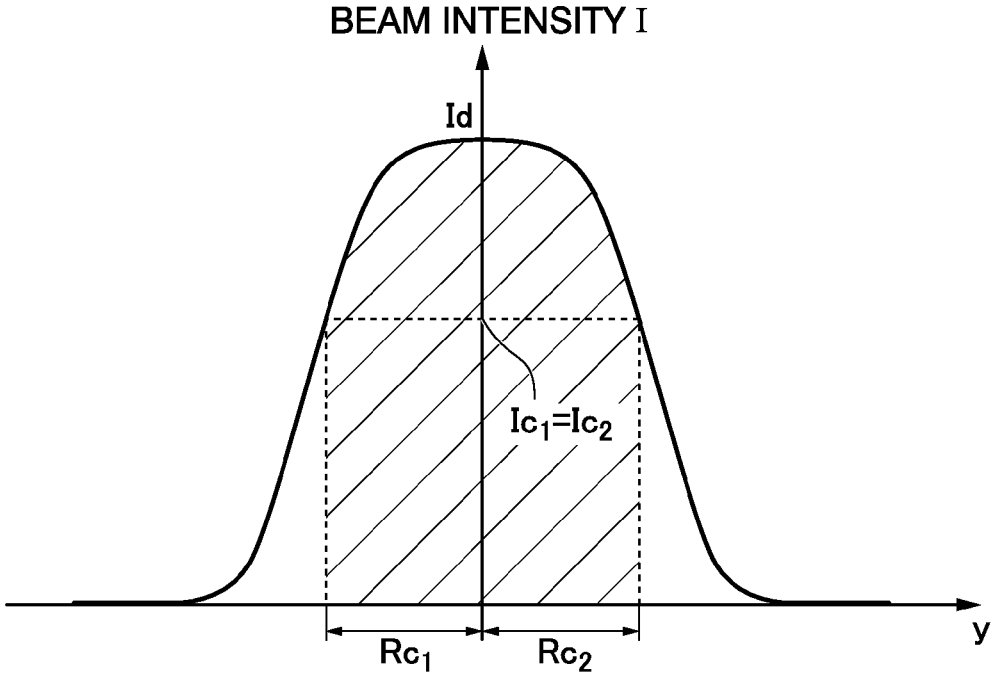
FIG. 11 is a view showing the intensity distribution of the laser beam according to the present embodiment on the cross-section perpendicular to the laser beam scanning direction.

In a case in which the laser beam focused and moved in the present embodiment is seen on a cross-section in the scanning direction of the laser beam passing through the centroid of the laser beam with respect to a direction orthogonal to the scanning direction, the laser beam intensity distribution (C direction intensity distribution) appears in a shape as shown in FIG. 11. FIG. 11 is a view in which, in a case in which the scanning direction of the laser beam is indicated along the y axis, the beam intensity I is indicated along the vertical axis, and the distance y from the centroid of the intensity distribution is indicated along the horizontal axis. Here, the centroid of the laser beam with respect to a direction orthogonal to the scanning direction is defined as the centroid position x of the intensity integration value (this integration value serves as a function of y) obtained by the integral of the intensity distribution of the laser beam, which serves as functions of x and y, along the y axis with respect to individual x values.

In the intensity distribution of the laser beam in FIG. 11, the distance from the centroid of the intensity distribution to a position on the y axis at which the intensity integration value obtained by the integral of the intensity distribution from the centroid of the intensity distribution in the −y direction (the third direction, the left direction on the paper in FIG. 11) is 43% of the total intensity integration value is represented by $Rc_1$, the distance from the centroid of the intensity distribution to a position on the y axis at which the intensity integration value obtained by the integral of the intensity distribution from the centroid of the intensity distribution in the +y direction (the fourth direction, the right direction on the paper in FIG. 11) is 43% of the total intensity integration value is represented by $Rc_2$ (that is, in FIG. 11, the area of the hatched region accounts for 86% of the value obtained by the integral of the entire intensity distribution in FIG. 11), the beam intensity at the position of the distance $Rc_1$ is represented by $Ic_1$, the beam intensity at the position of the distance $Rc_2$ is represented by $Ic_2$, the average value of $Ic_1$ and $Ic_2$ is represented by Ic, and the beam intensity at the centroid of the intensity distribution is represented by Id, Ic and Id satisfy $Id/Ic \geq 1.5$.

Figure 12:
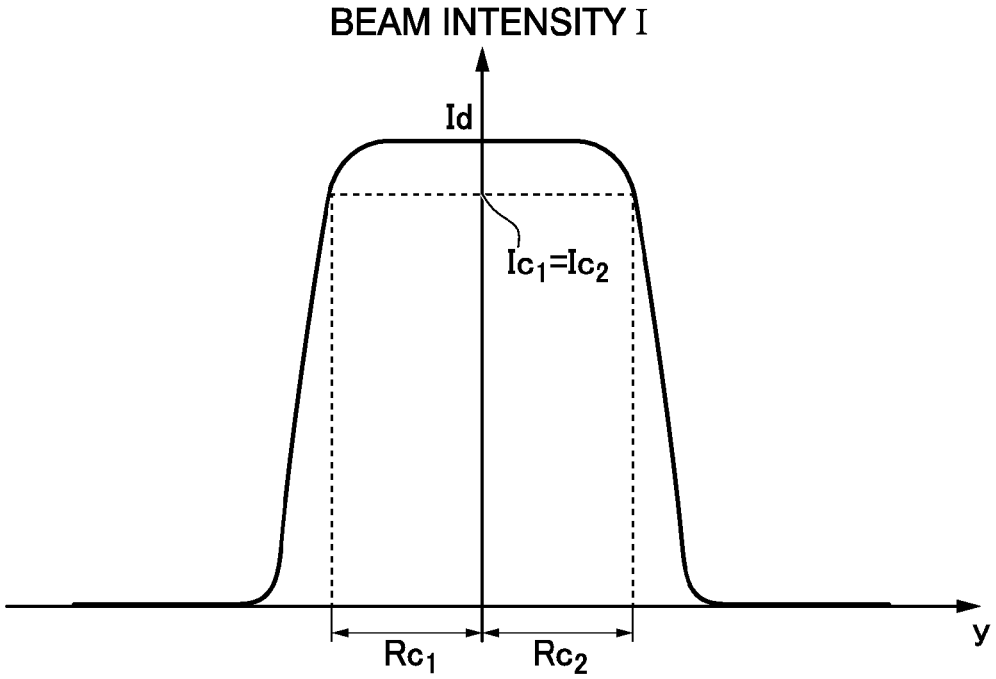
FIG. 12 is a view showing the intensity distribution of the laser beam according to the comparative example on the cross-section perpendicular to the laser beam scanning direction.

The comparative example shown in FIG. 12 is an intensity distribution in a case in which the beam intensity distribution is close to a so-called top flat distribution. In such a case, Id/Ic is less than 1.5. In the top flat-type intensity distribution, an abrupt temperature increase on the surface of the grain-oriented electrical steel sheet occurs in response to an abrupt rise in the spatial intensity distribution, and flaws become likely to be generated in the films due to a thermal shock.

When Id/Ic is 1.5 or more, the intensity distribution smoothly rises, and the abrupt temperature increase on the surface of the grain-oriented electrical steel sheet is suppressed, and thus flaws are not easily generated in the films, which is preferable.

When Id/Ic becomes too great, the intensity at the centroid section becomes too high, and therefore it is desirable to set Id/Ic to 10 or less.

Figure 13:
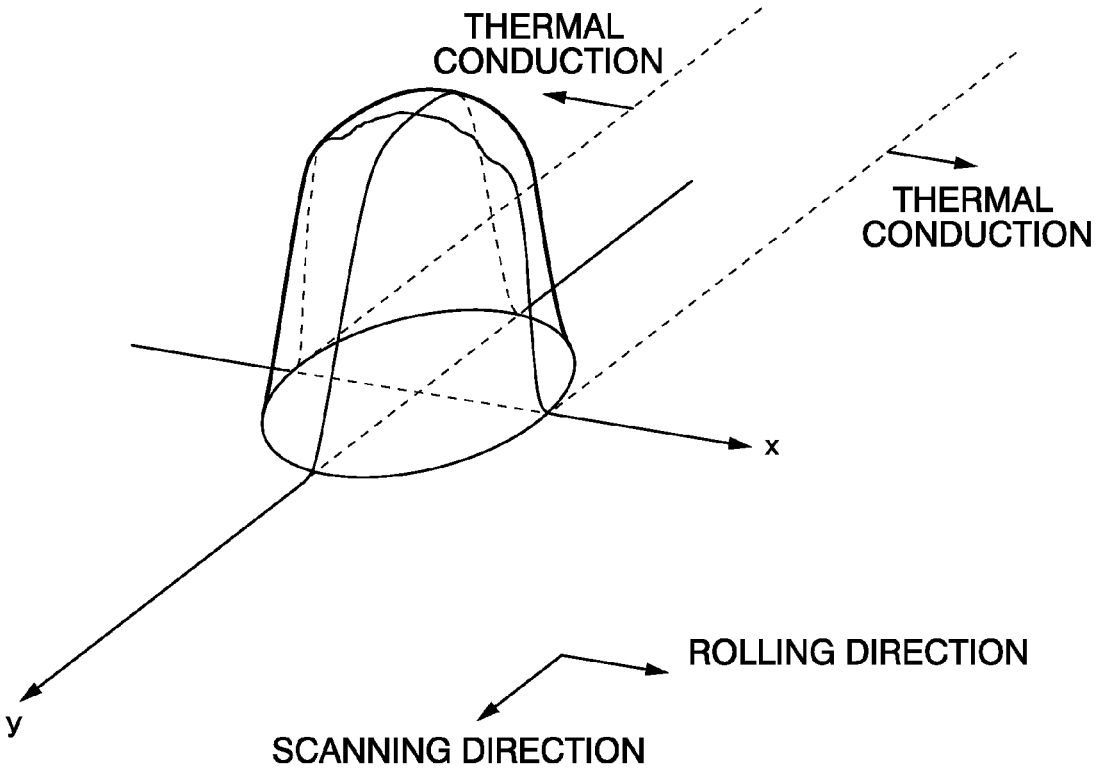
FIG. 13 is a schematic view showing the intensity distribution of the laser beam according to the present embodiment.

FIG. 13 is a schematic view showing the beam intensity of the laser beam in which the distribution of the beam intensity I on a cross-section perpendicular to the scanning direction of the laser beam is as in FIG. 7, and the distribution of the beam intensity I on a cross-section in the scanning direction of the laser beam is as in FIG. 11.

EXAMPLES

The present examples and the comparative examples will be described to confirm the effectiveness of the examples according to the present embodiment described above.

First, a slab having a chemical composition of Si: 3.0 mass %, C: 0.05 mass %, Mn: 0.1 mass %, acid-soluble Al: 0.02 mass %, N: 0.01 mass %, S: 0.01 mass %, and P: 0.02 mass % with the balance of Fe and impurities was prepared. Hot rolling was carried out on this slab at 1280° C., thereby obtaining a 2.3 mm-thick hot-rolled sheet. Next, a thermal treatment was carried out on the obtained hot-rolled sheet under conditions of 1000° C.×1 minute (a heating temperature of 1000° C. and a soaking time of 1 minute). After the thermal treatment, a pickling was carried out on the hot-rolled sheet, and cold rolling was carried out, thereby obtaining a 0.23 mm-thick cold-rolled sheet. Decarburization annealing was carried out on this cold-rolled sheet at 800° C. for 2 minutes. Next, an annealing separator mainly including magnesia was applied to both surfaces of the cold-rolled sheet that had been subjected to the decarburization annealing. In addition, the cold-rolled sheet onto which the annealing separator had been applied was coiled in a coil shape, was put into a batch-type furnace, and final annealing was carried out at 1200° C. for 20 hours. Therefore, a steel sheet (the base steel sheet 12) having glass films formed on both surfaces was manufactured. Next, an insulating material made of aluminum phosphate was applied onto the glass films 14, and then baking (850° C.×1 minute) was carried out, thereby forming the insulation films 16.

In addition, the base steel sheet 12 on which the insulation films 16 and the glass films 14 were formed was irradiated with a laser beam, and strain was imparted to the surface of the base steel sheet 12.

The laser irradiation unit 106 shown in FIG. 3 was used as a laser irradiation unit, the spot shape of the laser beam on the steel sheet surface was set to an elliptical shape, and the long axis of the ellipse was aligned in the scanning direction of the laser beam on the steel sheet surface. In addition, to compare the present example and the comparative example, tests were carried out under a variety of conditions in which Ib/Ia, Ra, and Id/Ic, which are defined as described above, were differed with respect to the intensity distributions of the beam on a cross-section in the scanning direction of the laser beam and a cross-section in a direction perpendicular to the scanning direction by changing a variety of conditions such as the type of a fiber laser that was used as the laser oscillator 102, the core diameter of the optical fiber, the focal length of the collimator lens, the focal lengths of the metal mirror 126 and the paraboloid mirror 130, and the distances from these optical elements to the steel sheet surface. Regarding the irradiation conditions, the scanning speed Vc was set to 160 m/s, the irradiation pitch PL was set to 5 mm, and the wavelength λ of the laser beam was set to 1.08 μm.

Ib/Ia was experimentally obtained as described below. First, the beam intensity distribution at the steel sheet surface position was measured using a commercially available focused laser beam evaluation instrument. Next, the beam intensity distribution on the short axes of the ellipses of the measured elliptical laser beam spots, that is, a cross-section perpendicular to the scanning direction of the laser beam passing through the centroid of the laser beam with respect to the scanning direction of the laser beam was obtained. Finally, $Ra_1$, $Ra_2$, Ra which is the average value of $Ra_1$ and $Ra_2$, and Ia were obtained, and Ib/Ia was computed.

Simultaneously, the beam intensity distribution on the long axes of the ellipses of the measured elliptical laser beam spots, that is, a cross-section in the scanning direction of the laser beam passing through the centroid of the laser beam with respect to a direction orthogonal to the scanning direction of the laser beam was obtained, $Rc_1$, $Rc_2$, Rc which is the average value of $Rc_1$ and $Rc_2$, and Ic were obtained, and Id/Ic was computed.

Meanwhile, in the laser beam used in the present example, $Ra_1$ was equal to $Ra_2$, and $Rc_1$ was equal to $Rc_2$.

A part of the laser-treated steel sheet and a laser-untreated section of the steel sheet sampled from the same coil were put into a single sheet tester (SST), and a core loss $W_{17/50}$ (W/kg) was evaluated. $W_{17/50}$ represents the core loss at a frequency of 50 Hz and a maximum magnetic flux density of 1.7 T. As test specimens for the SST measurement, rectangular specimens cut into sizes of a steel sheet width direction length of 100 mm and a steel sheet rolling direction length of 500 mm were used. The core loss improvement ratio (%) of the laser-treated steel sheet is defined on the basis of the core loss of the laser-untreated section of the steel sheet sampled from the same coil.

In addition, whether or not rust was generated by the generation of flaws in the glass film 14 was determined through a humidity cabinet test. The humidity cabinet test was carried out in accordance with JIS K2246-5.34, and the test conditions were set to a temperature of 50° C., a humidity of 98%, and a test time of 72 hours. After that, whether or not rust was generated in the laser-irradiated section was visually checked. For individual conditions, 10 rectangle specimens having sizes of a steel sheet width direction length of 100 mm and a steel sheet rolling direction length of 500 mm were cut out, and evaluation was carried out on the basis of the number of specimens on which rust is generated.

The test results are described in Table 1. In Examples 1 to 5 in which Ib/Ia was 2.0 or less, a sufficient core loss improvement ratio of 12% or more was obtained. In addition, there was no specimen on which rust was generated, and the generation of flaws in the glass film 14 by the laser irradiation was suppressed.

Example 6 is an example in which the steel sheet surface was set to the focal position of the metal mirror 126. In this case, the C direction intensity distribution became close to the top flat distribution, and Id/Ic was 1.3. When Example 6 is compared with Examples 3 and 4 having the same Ib/Ia, the core loss was improved to the same extent, but there were two samples on which rust was generated. From the above-described results, it is found that Id/Ic is desirably set to 1.5 or more since flaws are not easily generated in the films.

In addition, when Example 1 and Examples 2 to 6 are compared with each other, it is found that Id/Ic is desirably set to be greater than Ib/Ia since the core loss is further improved.

Comparative Example 1 is an example in which the $TEM_{00}$ mode laser (laser beam) was used. In Comparative Example 1, Ib/Ia was 2.8, and the core loss improvement ratio was 10.2%. While a core loss improvement of 12% or more is required to satisfy the target product grade, Comparative Example 1 failed to achieve the target in terms of the core loss improvement ratio. Furthermore, in Comparative Example 1, rust was generated in the glass film 14 in two specimens out of 10.

Comparative Example 2 as well is an example in which the $TEM_{00}$ mode laser (laser beam) was used. When Ra ($Ra_1$ and $Ra_2$) was decreased using the good focusability of the $TEM_{00}$ mode as in Comparative Example 2, a core loss improvement of 12% or more was obtained. However, in a case in which the $TEM_{00}$ mode laser was used with a reduced Ra, it is found that rust was generated in all 10 samples, and flaws are significantly generated in the glass films 14 by the laser irradiation. In a case in which a laser is used under the conditions of Comparative Example 2, it becomes necessary to coat the insulation films 16 again, and thus the manufacturing costs significantly increase.

TABLE 1

| | Ib/Ia | Ra (mm) | Id/Ic | Rc (mm) | BPP (mm · mrad) | Laser output power P (kW) | Iron loss improvement ratio η (%) | Number of specimens with rust generation (specimens) |
|---|---|---|---|---|---|---|---|---|
| Example 1 | 2.0 | 0.06 | 1.9 | 1.5 | 1.6 | 2 | 12.0 | 0 |
| Example 2 | 1.6 | 0.06 | 1.9 | 1.5 | 3.8 | 2 | 13.9 | 0 |
| Example 3 | 1.2 | 0.06 | 1.8 | 1.5 | 6.0 | 2 | 14.0 | 0 |
| Example 4 | 1.2 | 0.06 | 1.5 | 1.5 | 6.0 | 2 | 13.9 | 0 |
| Example 5 | 1.0 | 0.06 | 1.7 | 1.5 | 10 | 2 | 14.2 | 0 |
| Example 6 | 1.2 | 0.06 | 1.3 | 1.5 | 6.0 | 2 | 14.1 | 2 |
| Comparative Example 1 | 2.8 | 0.06 | 2.8 | 1.5 | 0.37 | 2 | 10.2 | 2 |
| Comparative Example 2 | 2.8 | 0.04 | 2.8 | 1.5 | 0.37 | 2 | 12.4 | 10 |

From the above-described test results, it is found that, when Ib/Ia is set to 2.0 or less as in the present example, not only a sufficient core loss-improving effect but also an effect that suppresses the generation of flaws in the glass film 14 is obtained. In addition, it is found that, when Id/Ic is set to 1.5 or more, the generation of flaws can be further suppressed.

As described above, in the intensity distribution on a cross-section in a direction perpendicular to the scanning direction of the laser beam, when the distances from the centroid of the intensity distribution to the positions at which the intensity integration value from the centroid of the intensity distribution is 43% of the total intensity integration value are represented by $Ra_1$ and $Ra_2$, the intensities of the laser beam corresponding to $Ra_1$ and $Ra_2$ are respectively represented by $Ia_1$ and $Ia_2$, the average value of $Ia_1$ and $Ia_2$ is represented by Ia, and furthermore, the intensity of the laser beam at the centroid of the intensity distribution is represented by Ib, the laser processing apparatus 100 according to the present embodiment is constituted so that Ib/Ia is 2.0 or less. Therefore, it is possible to set the intensity distribution of the laser beam on the surface of the grain-oriented electrical steel sheet 10 to an optimal shape. As a result, it is possible to reduce thermal conduction in a direction orthogonal to the scanning direction when the laser beam is moved in the scanning direction. Therefore, even in a case in which the spot shape is made to be elliptical to form closures domains having a sufficient intensity, and accordingly, the irradiation time with the laser beam at one point on the grain-oriented electrical steel sheet 10 becomes long, it becomes possible to limit an increase in the closure domain width caused by thermal conduction. As a result, it becomes possible to further reduce the core loss of the grain-oriented electrical steel sheet 10.

In addition, in the intensity distribution of the laser beam according to the present embodiment, it is possible to restrict the beam intensity Ib from becoming too high at the centroid of the intensity distribution, and thus it is possible to limit the local temperature increase on the surface of the grain-oriented electrical steel sheet 10, and consequently, it is possible to inhibit the generation of flaws in the glass films 14.

According to the laser processing apparatus 100 according to the present embodiment, since the core loss is reduced, and flaws in the glass films are decreased, it is possible to stably manufacture the grain-oriented electrical steel sheet 10 having low core loss with a favorable yield. As a result, not only does it become possible to supply the grain-oriented electrical steel sheet 10 having low core loss at a lower price, but it is also possible to reduce the energy consumption by widely distributing the grain-oriented electrical steel sheet 10 having low core loss across the globe. Therefore, significant economic effects are exhibited.

Thus far, the preferred embodiment and examples of the present invention have been described in detail with reference to the accompanying drawings, but the present invention is not limited thereto. It is needless to say that a person skilled in the art can conceive of a variety of modified examples and corrected examples within the scope of the technical ideas described in the claims, and those examples are also, surely, interpreted to be included in the technical scope of the present invention.

INDUSTRIAL APPLICABILITY

According to the present invention, it becomes possible to suppress the generation of flaws in the glass films while reducing the core loss of the grain-oriented electrical steel sheet.

REFERENCE SYMBOL LIST

10: GRAIN-ORIENTED ELECTRICAL STEEL SHEET
12: BASE STEEL SHEET
14: GLASS FILM
16: INSULATION FILM
100: LASER PROCESSING APPARATUS
102: LASER OSCILLATOR
104: TRANSMISSION FIBER
106: LASER IRRADIATION UNIT
122: LASER HEAD
124: COLLIMATOR LENS
126: METAL MIRROR
128: POLYGON MIRROR
130: PARABOLOID MIRROR

What is claimed is:

1. A laser processing apparatus for reducing a magnetic domain size of a grain-oriented electrical steel sheet by focusing a laser beam on the grain-oriented electrical steel sheet and scanning the grain-oriented electrical steel sheet in a scanning direction with the laser beam, the laser processing apparatus comprising:

a laser oscillator emitting the laser beam; and a laser irradiation unit applying the laser beam transmitted from the laser oscillator to the grain-oriented electrical steel sheet, wherein the laser irradiation unit has a structure providing an intensity distribution of the laser beam focused on the grain-oriented electrical steel sheet on a cross-section in a direction perpendicular to the scanning direction on the grain-oriented electrical steel sheet so as to satisfy $Ib/Ia \leq 2$, where, when an integral of the intensity distribution is calculated from a centroid of the intensity distribution in each of a first direction and a second direction which are both perpendicular to the scanning direction, $Ra_1$ is a distance between the centroid of the intensity distribution and a position at which an intensity integration value from the centroid of the intensity distribution in the first direction is 43% of a total intensity integration value, $Ra_2$ is a distance between the centroid of the intensity distribution and a position at which an intensity integration value from the centroid of the intensity distribution in the second direction is 43% of the total intensity integration value, a beam intensity $Ia_1$ is an intensity corresponding to the $Ra_1$, the beam intensity $Ia_2$ is an intensity corresponding to the $Ra_2$, Ia is an average value of the beam intensity $Ia_1$ and the beam intensity $Ia_2$ and Ib is a beam intensity of the laser beam at the centroid of the intensity distribution.

2. The laser processing apparatus according to claim 1, wherein the structure of the laser irradiation unit provides a C direction intensity distribution of the laser beam focused on the grain-oriented electrical steel sheet on a cross-section in the scanning direction on the grain-oriented electrical steel sheet so as to satisfy $1.5 \leq Id/Ic \leq 10$, where, when an integral of the C direction intensity distribution is calculated from a centroid of the C direction intensity distribution in each of a third direction and a fourth direction which are both along the scanning direction, $Rc_1$ is a distance between the centroid of the C direction intensity distribution and a position at which an intensity integration value from the centroid of the C direction intensity distribution in the third direction is 43% of a total C direction intensity integration value, $Rc_2$ is a distance between the centroid of the C direction intensity distribution and a position at which an intensity integration value from the centroid of the C direction intensity distribution in the fourth direction is 43% of the total C direction intensity integration value, a beam intensity $Ic_1$ is an intensity corresponding to the $Rc_1$, a beam intensity $Ic_2$ is an intensity corresponding the $Rc_2$, Ic is an average value of the beam intensity $Ic_1$ and the beam intensity $Ic_2$ and Id is a beam intensity of the laser beam at the centroid of the C direction intensity distribution.

3. The laser processing apparatus according to claim 1, wherein the Ib/Ia is within a range of 1.0 to 2.0.

4. The laser processing apparatus according to claim 1, wherein Ra is within a range of 5 μm to 100 μm, where the Ra is an average value of the $Ra_1$ and the $Ra_2$.

5. The laser processing apparatus according to claim 4, wherein the Ra is within a range of 5 μm to 60 μm.

6. The laser processing apparatus according to claim 1, wherein a beam parameter product of the laser beam focused on the grain-oriented electrical steel sheet is within a range of $\lambda/\pi$ to 10 mm·mrad, where $\lambda$ is a wavelength of the laser beam in units of μm.

7. The laser processing apparatus according to claim 1, wherein the laser oscillator is a fiber laser or a disc laser.

8. The laser processing apparatus according to claim 1, wherein a spot shape of the laser beam focused on the grain-oriented electrical steel sheet is an ellipse, and a short axis direction of the ellipse is perpendicular to the scanning direction.

9. A laser irradiation method comprising a laser irradiation step for reducing a magnetic domain size of a grain-oriented electrical steel sheet by focusing a laser beam on the grain-oriented electrical steel sheet and scanning the grain-oriented electrical steel sheet in a scanning direction with the laser beam, wherein Ib/Ia is 2.0 or less in an intensity distribution of the laser beam focused on the grain-oriented electrical steel sheet on a cross-section in a direction perpendicular to the scanning direction on the grain-oriented electrical steel sheet, where, when an integral of the intensity distribution is calculated from a centroid of the intensity distribution in each of a first direction and a second direction which are both perpendicular to the scanning direction, $Ra_1$ is a distance between the centroid of the intensity distribution and a position at which an intensity integration value from the centroid of the intensity distribution in the first direction is 43% of a total intensity integration value, $Ra_2$ is a distance between the centroid of the intensity distribution and a position at which an intensity integration value from the centroid of the intensity distribution in the second direction is 43% of the total intensity integration value, a beam intensity $Ia_1$ is an intensity corresponding to the $Ra_1$, the beam intensity $Ia_2$ is an intensity corresponding to the $Ra_2$, Ia is an average value of the beam intensity $Ia_1$ and the beam intensity $Ia_2$ and Ib is a beam intensity of the laser beam at the centroid of the intensity distribution.

10. The laser irradiation method according to claim 9, wherein Id/Ic falls within a range of 1.5 to 10 in a C direction intensity distribution of the laser beam focused on the grain-oriented electrical steel sheet on a cross-section in the scanning direction on the grain-oriented electrical steel sheet, where, when an integral of the C direction intensity distribution is calculated from a centroid of the C direction intensity distribution in each of a third direction and a fourth direction which are both along the scanning direction, $Rc_1$ is a distance between the centroid of the C direction intensity distribution and a position at which an intensity integration value from the centroid of the C direction intensity distribution in the third direction is 43% of a total C direction intensity integration value, $Rc_2$ is a distance between the centroid of the C direction intensity distribution and a position at which an intensity integration value from the centroid of the C direction intensity distribution in the fourth direction is 43% of the total C direction intensity integration value, a beam intensity $Ic_1$ is an intensity corresponding to the $Rc_1$, a beam intensity $Ic_2$ is an intensity corresponding the $Rc_2$, Ic is an average value of the beam intensity $Ic_1$ and the beam intensity $Ic_2$ and Id is a beam intensity of the laser beam at the centroid of the C direction intensity distribution.

11. The laser processing apparatus according to claim 1, wherein the laser irradiation unit includes a mirror adjusting the Ib/Ia so as to satisfy Ib/Ia≤2.

12. The laser irradiation method according to claim 9, wherein the Ib/Ia is within a range of 1.0 to 2.0.

13. The laser irradiation method according to claim 9, wherein Ra is within a range of 5 μm to 100 μm where the Ra is an average value of the $Ra_1$ and the $Ra_2$.

14. The laser irradiation method according to claim 13, wherein the Ra is within a range of 5 μm to 60 μm.

15. The laser irradiation method according to claim 9, wherein a spot shape of the laser beam focused on the grain-oriented electrical steel sheet is an ellipse, and a short axis direction of the ellipse is perpendicular to the scanning direction.

16. The laser processing apparatus according to claim 2, wherein the Ib/Ia is within a range of 1.0 to 2.0.

17. The laser processing apparatus according to claim 2, wherein Ra is within a range of 5 μm to 100 μm, where the Ra is an average value of the $Ra_1$ and the $Ra_2$.

18. The laser processing apparatus according to claim 2, wherein a beam parameter product of the laser beam focused on the grain-oriented electrical steel sheet is within a range of $\lambda/\pi$ to 10 mm·mrad, where $\lambda$ is a wavelength of the laser beam in units of μm.

19. The laser processing apparatus according to claim 2, wherein the laser oscillator is a fiber laser or a disc laser.

20. The laser processing apparatus according to claim 2, wherein a spot shape of the laser beam focused on the grain-oriented electrical steel sheet is an ellipse, and a short axis direction of the ellipse is perpendicular to the scanning direction.

* * * * *